US008496055B2

(12) United States Patent
Mootoo et al.

(10) Patent No.: US 8,496,055 B2
(45) Date of Patent: Jul. 30, 2013

(54) EFFICIENT SINGLE TRIP GRAVEL PACK SERVICE TOOL

(75) Inventors: Dexter Myles Mootoo, Houston, TX (US); Robert Krush, Sugar Land, TX (US); John Whitsitt, Houston, TX (US); Adam Charles Vasper, Surrey (GB); Graham Watson, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 225 days.

(21) Appl. No.: 12/580,736

(22) Filed: Oct. 16, 2009

(65) Prior Publication Data

US 2010/0163235 A1 Jul. 1, 2010

Related U.S. Application Data

(60) Provisional application No. 61/141,383, filed on Dec. 30, 2008.

(51) Int. Cl.
*E21B 43/04* (2006.01)

(52) U.S. Cl.
USPC ..... 166/278; 166/51; 166/316; 166/205; 166/373

(58) Field of Classification Search
USPC ..... 166/278, 369, 305.1, 51, 316, 373, 166/205
See application file for complete search history.

(56) References Cited

U.S. PATENT DOCUMENTS

| | | | | |
|---|---|---|---|---|
| 2,340,481 A | | 2/1944 | Lloyd | |
| RE24,617 E | | 3/1959 | Greene | |
| 3,439,740 A | | 4/1969 | Conover | |
| 3,884,301 A | * | 5/1975 | Turner et al. | 166/278 |
| 4,428,431 A | | 1/1984 | Landry et al. | |
| 4,519,451 A | | 5/1985 | Gray | |
| 4,566,538 A | | 1/1986 | Peterson | |
| 5,174,379 A | * | 12/1992 | Whiteley et al. | 166/278 |
| 5,377,750 A | | 1/1995 | Arterbury | |

(Continued)

FOREIGN PATENT DOCUMENTS

| | | |
|---|---|---|
| EP | 0430389 B1 | 7/1994 |
| GB | 2083854 A | 3/1982 |

(Continued)

OTHER PUBLICATIONS

Integrated Perforating and Gravel Packing Speeds Completions, Case Study: PERFPAC Service Reduces Formation Damage, Saves Rig Time in West African Deepwater Play. 06-WT-084, Aug. 2006.

(Continued)

*Primary Examiner* — Nicole Coy
(74) *Attorney, Agent, or Firm* — David G. Matthews; Brandon Clark; Robb D. Edmonds

(57) ABSTRACT

A service tool and methods for performing subterranean hydrocarbon services in a wellbore. The service tool can include a body that having an aperture formed therethrough. A valve system can be connected to the body. The valve system can selectively form a flow path between a first portion of the aperture and a second portion of the aperture; a flow path between a first flow port formed through a first portion of the body, the aperture, and the outer diameter of the body; and/or a flow path between a channel formed in a portion of the body, a second flow port formed through a second portion of the body, and the second portion of the aperture.

18 Claims, 8 Drawing Sheets

U.S. PATENT DOCUMENTS

| | | | | |
|---|---|---|---|---|
| 5,609,204 | A | 3/1997 | Rebardi et al. | |
| 5,636,691 | A | 6/1997 | Hendrickson et al. | |
| 5,875,852 | A | 3/1999 | Floyd et al. | |
| 5,921,318 | A | 7/1999 | Ross | |
| 5,988,285 | A | 11/1999 | Tucker et al. | |
| 6,059,032 | A | 5/2000 | Jones | |
| 6,059,033 | A | 5/2000 | Ross et al. | |
| 6,148,915 | A | 11/2000 | Mullen et al. | |
| 6,216,785 | B1 | 4/2001 | Achee, Jr. et al. | |
| 6,220,353 | B1 | 4/2001 | Foster | |
| 6,230,801 | B1 | 5/2001 | Hill, Jr. et al. | |
| 6,302,216 | B1 | 10/2001 | Patel | |
| 6,343,651 | B1 | 2/2002 | Bixenman | |
| 6,371,210 | B1 | 4/2002 | Bode et al. | |
| 6,446,729 | B1 | 9/2002 | Bixenman et al. | |
| 6,464,006 | B2 | 10/2002 | Womble | |
| 6,488,082 | B2 | 12/2002 | Echols | |
| 6,568,474 | B2 | 5/2003 | George et al. | |
| 6,575,246 | B2 | 6/2003 | Bixenman et al. | |
| 6,622,794 | B2 | 9/2003 | Zisk, Jr. | |
| 6,702,020 | B2 | 3/2004 | Zachman et al. | |
| 6,719,064 | B2 | 4/2004 | Price-Smith | |
| 6,729,407 | B2 | 5/2004 | Stoesz | |
| 6,745,834 | B2 | 6/2004 | Davis | |
| 6,749,023 | B2 | 6/2004 | Nguyen et al. | |
| 6,766,857 | B2 | 7/2004 | Bixenman et al. | |
| 6,766,862 | B2 | 7/2004 | Chatterji et al. | |
| 6,782,948 | B2 | 8/2004 | Echols et al. | |
| 6,786,285 | B2 | 9/2004 | Oddie | |
| 6,886,634 | B2 | 5/2005 | Richards | |
| 6,899,176 | B2 | 5/2005 | Hailey, Jr. et al. | |
| 6,907,936 | B2 | 6/2005 | Fehr et al. | |
| 6,978,840 | B2 | 12/2005 | Henderson | |
| 6,983,796 | B2 | 1/2006 | Bayne et al. | |
| 6,988,547 | B2 | 1/2006 | Goodwin | |
| 7,017,664 | B2 | 3/2006 | Walker et al. | |
| 7,021,384 | B2 | 4/2006 | Themig | |
| 7,055,598 | B2 | 6/2006 | Ross et al. | |
| 7,100,690 | B2 | 9/2006 | Mullen et al. | |
| 7,124,824 | B2 | 10/2006 | Turner et al. | |
| 7,128,151 | B2 | 10/2006 | Corbett | |
| 7,152,678 | B2 | 12/2006 | Turner et al. | |
| 7,210,527 | B2 | 5/2007 | Walker et al. | |
| 7,237,616 | B2 | 7/2007 | Patel | |
| 7,252,152 | B2 | 8/2007 | LoGiudice et al. | |
| 7,331,388 | B2 | 2/2008 | Vilela et al. | |
| 7,367,395 | B2 * | 5/2008 | Vidrine et al. | 166/278 |
| 7,383,884 | B1 | 6/2008 | Turner et al. | |
| 7,472,750 | B2 | 1/2009 | Walker et al. | |
| 7,523,787 | B2 | 4/2009 | Richards et al. | |
| 7,712,524 | B2 | 5/2010 | Patel | |
| 7,918,276 | B2 * | 4/2011 | Guignard et al. | 166/278 |
| 8,056,628 | B2 | 11/2011 | Whitsett et al. | |
| 8,220,542 | B2 | 7/2012 | Whitsett et al. | |
| 2002/0007949 | A1 | 1/2002 | Tolman et al. | |
| 2002/0036087 | A1 | 3/2002 | Bixenman et al. | |
| 2002/0062960 | A1 | 5/2002 | George et al. | |
| 2002/0070019 | A1 | 6/2002 | Dusterhoft et al. | |
| 2003/0047311 | A1 | 3/2003 | Echols et al. | |
| 2003/0070809 | A1 | 4/2003 | Schultz et al. | |
| 2003/0188871 | A1 | 10/2003 | Dusterhoft et al. | |
| 2004/0094304 | A1 | 5/2004 | Turner et al. | |
| 2004/0118564 | A1 | 6/2004 | Themig et al. | |
| 2004/0129419 | A1 | 7/2004 | Van Wulfften Palthe | |
| 2004/0134656 | A1 | 7/2004 | Richards | |
| 2004/0251024 | A1 | 12/2004 | Jones | |
| 2005/0178552 | A1 | 8/2005 | Fehr et al. | |
| 2006/0042795 | A1 | 3/2006 | Richards | |
| 2006/0090900 | A1 | 5/2006 | Mullen et al. | |
| 2006/0113089 | A1 | 6/2006 | Henriksen et al. | |
| 2006/0124310 | A1 | 6/2006 | Lopez de Cardenas et al. | |
| 2006/0124311 | A1 | 6/2006 | Lopez de Cardenas et al. | |
| 2006/0124312 | A1 | 6/2006 | Rytlewski et al. | |
| 2006/0196660 | A1 | 9/2006 | Patel | |
| 2008/0128130 | A1 | 6/2008 | Whitsitt et al. | |
| 2008/0142225 | A1 | 6/2008 | Prado | |
| 2008/0164027 | A1 | 7/2008 | Sanchez | |
| 2009/0025923 | A1 | 1/2009 | Patel | |
| 2009/0145603 | A1 | 6/2009 | Coronado | |
| 2010/0013663 | A1 * | 1/2010 | Cavender et al. | 340/854.3 |

FOREIGN PATENT DOCUMENTS

| | | | |
|---|---|---|---|
| WO | 200005484 | A1 | 2/2000 |
| WO | 200165063 | A1 | 9/2001 |
| WO | 2003023185 | A1 | 3/2003 |

OTHER PUBLICATIONS

PERFPAC Image.

Quantum PERFPAC Single-Trip System; SC_03_044_0, Jan. 2004.

Schlumberger Ltd., Oilfield Glossary, "Rig", 2006.

Schlumberger Ltd., Oilfield Glossary, "Rigless Operation", 2006.

Schlumberger PERFPAC webpage.

Syed Ali et al., "Combined Stimulation and Sand Control" Oilfield Review Summer 2002 pp. 30-47; www.slb.com/media/resources/oilfieldreview/ors02/sum02/p30_47.pdf.

UK Intellectual Property Examination Report for U.K. Appln. No. GB 0721646.8 dated Mar. 27, 2009 (2 pages).

UK Intellectual Property Examination Report for U.K. Appln. No. GB 0721646.8 dated Feb. 29, 2008 (7 pages).

International Search Report for PCT Application No. PCT/US2008/050215.

International Search Report for PCT Application No. PCT/US2007/086507.

International Search Report for PCT Application No. PCT/US2009/067314.

* cited by examiner

EFFICIENT SINGLE TRIP GRAVEL PACK SERVICE TOOL

CROSS-REFERENCE TO RELATED APPLICATIONS

This application claims priority to U.S. Provisional Patent Application having Ser. No. 61/141,383, filed on Dec. 31, 2008, which is incorporated by reference herein.

BACKGROUND

Subterranean hydrocarbon services are often necessary to produce hydrocarbons from a subterranean formation. Such services can include, without limitation, perforating operations, completion operations, clean-up operations, flow-back operations, treatment operations, testing operations, production operations, injection operations, and monitor and control operations. Each service is typically performed by running specially designed, service-specific equipment into and out of the wellbore. This is problematic because each trip into and out of the wellbore increases operational risks, rig time, and personnel hours.

Previous attempts to reduce the number of trips into and out of a wellbore have relied on multiple mechanically-operated tools. Multiple mechanically-operated tools are limited by their available methods of operation. Additionally, multiple mechanically-operated tools provide limited feed-back on tool-function and lack the capability to monitor the subterranean formation and the wellbore in real-time.

SUMMARY

Apparatus and methods for performing one or more hydrocarbon service on a wellbore in a single trip are provided. In at least one specific embodiment, the apparatus can include a body having an aperture formed therethrough. A valve system can be connected to the body. The valve system can be used to selectively form a flow path between a first portion of the aperture and a second portion of the aperture. A first flow port can be formed through a first portion of the body. The valve system can also be used to selectively form a flow path between the first portion of the aperture, the first flow port, and an outer diameter of the body. The apparatus can also include a channel formed in a portion of the body. The channel can be isolated form the first portion of the aperture. The body can have a second flow port formed through a second portion thereof. The valve system can be used to selectively form a flow path between the second portion of the aperture, the second flow port, and the channel. One or more of the flow paths can be formed by the valve system without moving the body relative to the wellbore.

In one or more specific embodiments, the service tool can be integrated into a system. The system can include the service disposed within a tubular member. An annulus can be formed between the tubular member and the service tool. The tubular member can include a main body, and a flow port formed through the main body. A flow path can be selectively formed between the annulus and an exterior of the main body through the flow port formed through the main body. The flow path can be formed without longitudinal movement of the main body. The tubular member can also include a sand screen disposed adjacent the main body.

In at least one specific embodiment, a method for performing at least two hydrocarbon services on a wellbore in a single trip downhole can be performed using the service tool. The method can include locating the service tool within a wellbore adjacent a subterranean formation. As the service tool is located in the wellbore, the first and second flow ports can be isolated from the aperture of the body by the valve system, and wherein the flow path between the first portion of the body and the second portion of the body is formed by the valve system. The method can further include isolating the first portion of the body from the second portion of the body with the valve system without moving the service tool relative to the wellbore; forming the flow path through the first flow port between the first portion of the aperture of the body and the exterior of the body with the valve system without imparting motion to the service tool relative to the wellbore; and forming the flow path through the second port between the second portion of the aperture of the body and the channel without moving the service tool relative to the wellbore.

BRIEF DESCRIPTION OF THE DRAWINGS

So that the recited features can be understood in detail, a more particular description, briefly summarized above, may be had by reference to one or more embodiments, some of which are illustrated in the appended drawings. It is to be noted, however, that the appended drawings illustrate only typical embodiments and are therefore not to be considered limiting of its scope, for the invention may admit to other equally effective embodiments.

DETAILED DESCRIPTION

Figure 1:
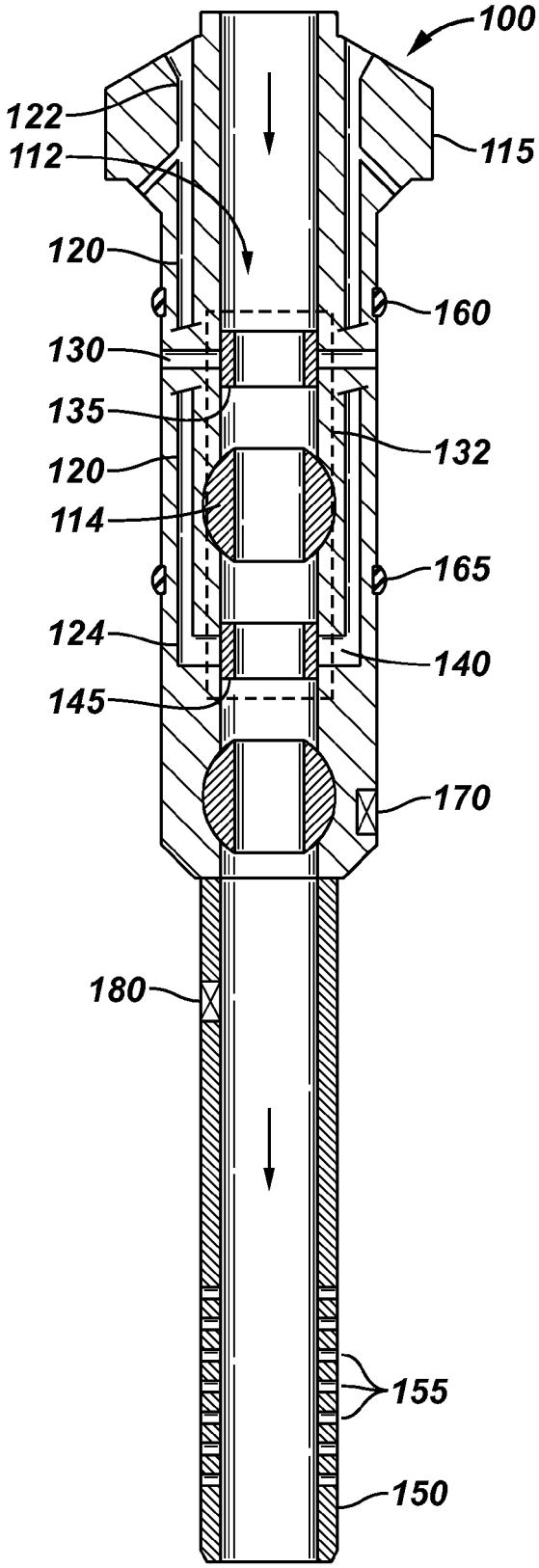
FIG. 1 depicts a cross sectional view of an illustrative service tool, according to one or more embodiments.

FIG. 1 depicts a cross sectional view of an illustrative service tool, according to one or more embodiments. In one or more embodiments, the service tool 100 can have a body 115 having an aperture or inner bore 112. The service tool 100 can also have one or more valve systems 132 for selectively providing one or more flow paths (three are shown 112, 130, 140) through the body 115 without longitudinally moving the service tool 100. The body 115 can be a tubular member and the aperture 112 can flow longitudinally therethrough. The body 115 can also have one or more radial flow ports 130, 140 formed therethrough. For example, the first flow port 130 can be formed through an "upper" or first portion of the body 115 and the second flow port 140 can be formed through a "lower" or second portion of the body 115.

As used herein, the terms "up" and "down;" "upper" and "lower;" "upwardly" and "downwardly;" "upstream" and "downstream;" and other like terms are merely used for convenience to depict spatial orientations or spatial relationships relative to one another in a vertical wellbore. However, when applied to equipment and methods for use in wellbores that are deviated or horizontal, it is understood to those of ordinary skill in the art that such terms are intended to refer to a left to right, right to left, or other spatial relationship as appropriate.

Still referring to FIG. 1, in one or more embodiments, the valve system 132 can include any number of valves and/or flow control devices. For example, the valve system 132 can include a single valve (not shown) that can be switched between different configurations and/or modes to selectively provide one or more flow paths through the body 115 and/or service tool 100. As such, the valve system 132 can be configured to selectively allow and/or prevent fluid flow through the one or more flow ports 130, 140 and/or between a first portion of the aperture 112 and the second portion of the aperture 112. The valve system 132 can enable the performance of one or more hydrocarbon services within a wellbore in a single trip. For example, the service tool 100 can be used to run a completion or a tubular member (not shown in FIG. 1) into a wellbore (not shown in FIG. 1) with the valve system 132 configured to provide one or more flow paths and perform one or more hydrocarbon services within a wellbore with the valve system 132 in one or more additional configurations. The valve system 132 can be connected to the body 115 in any way. For example, the valve system 132 can be connected to the body 115 by disposing at least a portion of the valve system 132 within at least a portion of the body 115, disposing at least a portion of the valve system 132 about at least a portion of the body 115, integrating at least a portion of the valve system 132 into at least a portion of the body 115, attaching one or more tubular members having at least a portion of the valve system 132 integrated therewith to at least a portion of the body 115, and/or otherwise attaching or securing at least a portion of the valve system 132 with the body 115 and/or another portion of the service tool 100. Furthermore, the valve system 132 can selectively isolate one or more portions of the aperture 112 from one another. The valve system 132 can allow one or more triggers (not shown) to flow through the body 115 to actuate one or more pieces of downhole or completion equipment (not shown) connected thereto. The triggers can include, but not limited to, balls, bars, chemicals, and/or darts. The triggers can be used to actuate one or more valves, detonate one or more perforating guns, and/or provide one or more signals to a downhole gauge or system. For example, a dart can flow through the body 115 and plug a valve disposed within a completion (not shown) connected to the service tool 100.

The flow ports 130, 140 can be or include one or more radial holes or apertures formed through the body 115. The flow ports 130, 140 can be selectively opened and closed to provide one or more flow paths between one or more portions of the body 115. For example, the first flow port 130 can be formed through the body 115 and selectively provide fluid communication between the exterior of the body 115 and the aperture 112. The second flow port 140 can be in selective fluid communication with a channel 120 and the aperture 112. Accordingly, the valve system 132 can provide a flow path between the aperture 112 and the exterior of the body 115 through the flow port 130. The valve system 132 can also provide a flow path between the channel 120 and the aperture 112 through the flow port 140.

The channel 120 can be formed within the wall of the body 115 and/or the channel 120 can be a conduit, pipe, or hose, disposed within the body 115. The channel 120 can have a first end 122 and a second end 124. The first end 122 can be in fluid communication with a portion of a wellbore adjacent an "upper" or first portion of the body 115, and/or the first end 122 can be configured to provide fluid communication with an "upper" or first assembly (not shown). The second end 124 can be adjacent the flow port 140, and the valve system 132 can selectively form a flow path through the flow port 140 between the second end 124 and the second portion of the aperture 112. In one or more embodiments, the flow path 120 can be isolated from the flow port 130 and/or the first portion of the aperture 112.

In one specific embodiment, such as the one depicted in FIG. 1, the valve system 132 can be or include two or more flow control devices (three are shown 114, 135, 145). The flow control devices 135, 145 can be disposed about or in the flow ports 130, 140 respectively, and the flow control device 114 can be disposed in the aperture 112 between the flow ports 130, 140. The flow control devices 114, 135, 145 can be sliding sleeves, ball valves, pressure relief valves, mechanically operated valves, hydraulically operated valves, electrically operated valves, and/or other valves. The flow control device 114 can be selectively switched between an "opened" or first configuration and a "closed" or second configuration. When the flow control device 114 is in the first configuration, the first portion of the aperture 112 is in fluid communication with the second portion of the aperture 112. If the flow control device 114 is in the second configuration, fluid communication between the first portion and the second portion of the aperture 112 is prevented. The flow control device 135 can be switched between an "opened" or first configuration and a "closed" or second configuration. Accordingly, when the flow control device 135 is in the first configuration, fluid is allowed to flow through the flow port 130, and when the flow control device 135 is in the second configuration, fluid is prevented from flowing through the flow port 130. The flow control device 145 can be selectively switched between an "opened" or first configuration and a "closed" or second configuration. When the flow control device 145 is in the first configuration, fluid is allowed to flow through the flow port 140, and when the flow control device 145 is in the second configuration, fluid is prevented from flowing through the flow port 140. The flow control devices 114, 135, 145 can be actuated without imparting motion to the service tool 100 relative to a wellbore. For example, the flow control devices 114, 135, 145 can be actuated hydraulically, mechanically, or electronically. In one or more embodiments, a stored potential energy source can be used to actuate the flow control devices 114, 135, 145. The stored potential energy source can be or include a battery, a capacitor, a spring, a fluidic accumulator, and/or differential pressure between hydrostatic and atmospheric chambers.

The service tool 100 can also include one or more sealing components or seals (two are shown 160, 165) disposed about the exterior of the body 115, and the sealing components 160, 165 can seal with a completion or tubular member (not shown in FIG. 1) disposed about the service tool 100. The sealing components 160, 165 can be any sealing member or mechanism that provides a seal. For example, the sealing components 160, 165 can be or include one or more molded rubber seals, composite rubber seals, and/or elastomeric o-rings.

In one or more embodiments, the service tool 100 can perform one or more hydrocarbon services, such a gravel packing, mudcake clean up, production, and acid treatment. For example, the service tool 100 can perform a well test concurrently with, subsequent to, or prior to conveying a completion into a wellbore. The service tool 100 can perform one or more hydrocarbon services with or without a wash pipe 150. Furthermore, full-bore access can be provided through the entire service tool 100, and/or full-bore access can be provided to the top of the wash-pipe 150, without movement of the service tool relative to the wellbore.

The wash pipe 150 can be connected to an end of the service tool 100, and can provide selective fluid communication between a tubular member or wellbore located about the service tool 100 and the aperture 112. The wash pipe 150 can be connected to the body 115 in a fixed position or the wash pipe 150 can be movably connected to the body 115. For example, the wash pipe 150 can be connected to the body 115 such that the wash pipe 150 can move from an "extended' or first position to a "contracted" or second position.

In one or more embodiments, the wash pipe 150 can have one or more flow ports 155 integrated therewith. The flow ports 155 can be configured to selectively move from an "opened" or first configuration to a "closed" or second configuration without imparting motion to the wash pipe 150 or service tool 100. For example, the flow ports 155 can be actuated or switched between the first and second configuration hydraulically, mechanically, or electronically. In one or more embodiments, the flow ports 155 can be switched from the first configuration to the second configuration by a stored potential energy source. The stored potential energy source can be or include a battery, a capacitor, a spring, a fluidic accumulator, and/or differential pressure between hydrostatic and atmospheric chambers. The flow ports 155 can be equipped with one or more nozzles or inserts to control the pressure drop of fluid flowing therethrough. In one or more embodiments, a wash pipe 150 without ports 155 can be used and the wash pipe 150 can be configured to dissolve after the service tool 100 is ran into a wellbore. The service tool 100 and/or wash pipe 150 can be connected to one or more completion accessories or pieces of equipment (not shown). The completion accessories can include swivels, poppet valves, mule-shoes, and the like.

The service tool 100 can also include monitoring equipment 170 and/or telemetry equipment 180. The monitoring equipment 170 can be disposed on the wash pipe 150, on a tubular member (not shown in FIG. 1) disposed about the service tool 100, the body 115, within the aperture 112, and/or on or about other portions of the service tool 100. The monitoring equipment 170 can include flow rate sensors, temperature sensors, pressure sensors, or other sensors or gauges capable of measuring a downhole condition. The monitoring equipment 170 can be configured to measure and quantify a productivity index and flow resistance. For example, the monitoring equipment 170 can measure the flow rate of hydrocarbons being produced from the wellbore, the pressure of the hydrocarbons at two or more locations within the wellbore, and a processor integrated or in communication with the monitoring equipment 170 can perform an algorithm to quantify and/or calculate the productivity index. The monitoring equipment 170 can also measure wellbore and/or subterranean formation or hydrocarbon bearing zone pressure as treatment fluid is conveyed into the wellbore to treat the wellbore and/or a subterranean formation. The monitoring equipment 170 can be hard wired or in wireless communication with monitoring equipment on the surface (not shown), such as a processor and/or other data storage devices. The monitoring equipment 170 and the processor and/or other data storage devices can form a monitoring system (not shown). The monitoring system can allow for data to be recorded, stored, interpreted, and processed near the wellbore. As such, the monitoring system can measure and store data or other information for diagnostic and commercial use. In one or more embodiments, the monitoring equipment 170 can be in communication with a satellite, and the data measured by the monitoring equipment 170 can be transmitted to the satellite. The satellite can send the data to one or more networked processors for further analysis and interpretation.

The telemetry equipment 180 can be used in conjunction with the monitoring equipment 170 or the telemetry equipment 180 can be used independent of the monitoring equipment 170. The telemetry equipment 180 can provide two-way telemetry between the service tool 100 and the surface. The telemetry equipment 180 can be used to send signals from the service tool 100 to the surface. For example, the telemetry equipment 180 can transmit data measured by the monitoring equipment 170 to the surface. The telemetry equipment 180 can also transmit signals from the surface to the service tool 100. For example, the telemetry equipment 180 can be used to transmit activation or actuation signals from the surface to the service tool 100. The actuation signals can be used to place one or more of the flow control devices 114, 135, 145 in the first and/or the second configuration. For example, the telemetry equipment 180 can be used to actuate, configure, and monitor the valve system 132 and/or the service tool 100 from the surface. In one or more embodiments, a fiber optic cable (not shown) can be in communication with the valve system 132 and a control system located at the surface, and the control system can send an actuation signal through the fiber optic cable to the valve system 132 to place the valve system 132 in one or more configurations or modes.

The telemetry equipment 180 can be configured to support at least one of wireless or wired telemetry. Wireless type telemetry can include annular flow rate pulse, tubing flow rate pulse, electromagnetic wave, acoustic wave, temperature, vibration, chemical, mechanical transmission, RF tag, fluid density, fluid ph value, fluid trace substance, fluid metallic particles, fluid conductivity, fluid viscosity, magnetic material, radioactive material, annular pressure pulse, tubing pressure pulse. Wire type telemetry can include one or more electric lines, hydraulic lines, fiber optic cables, and/or wired pipes.

Figure 2:
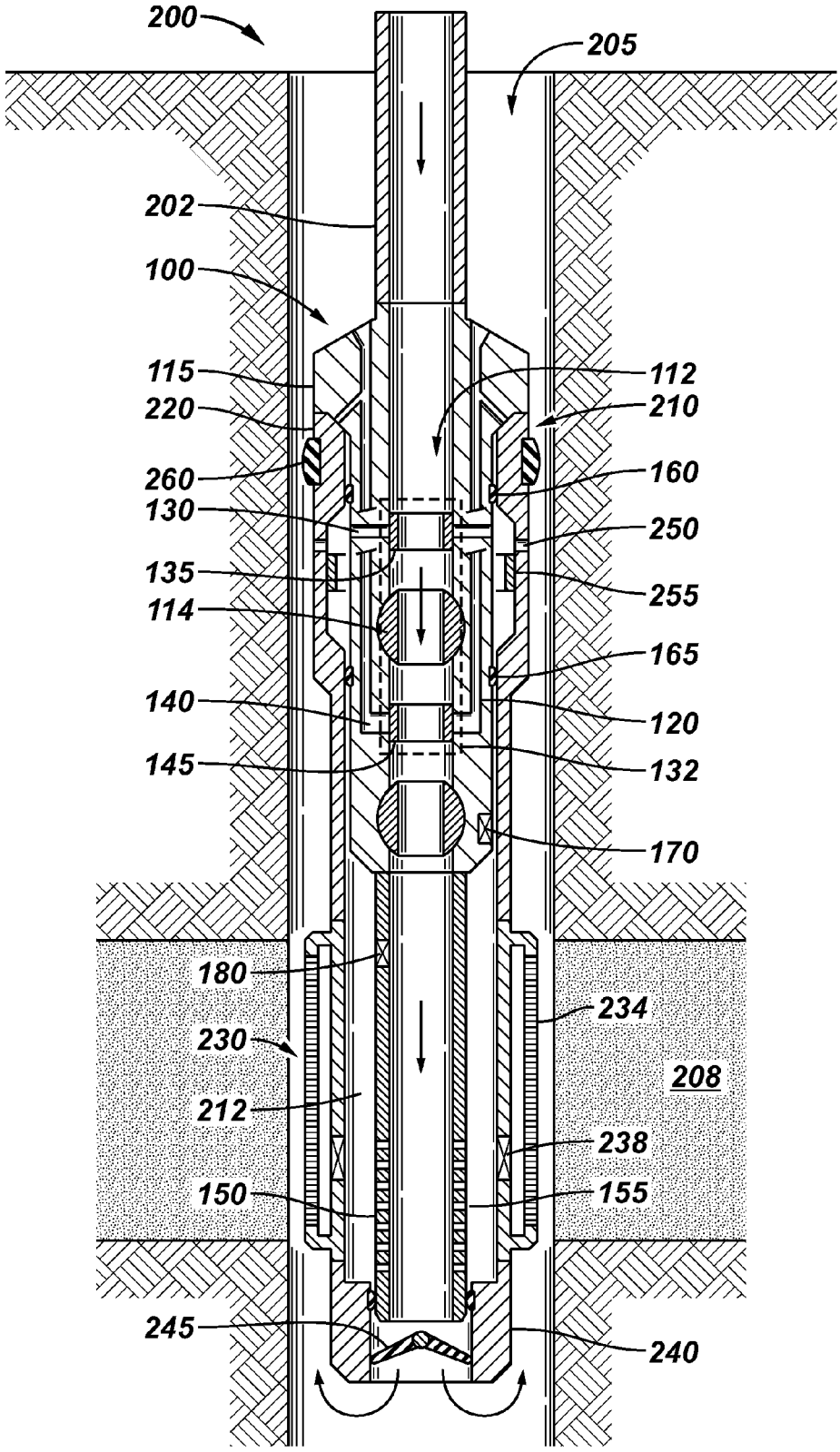
FIG. 2 depicts a cross sectional view an illustrative service tool system locating a completion in a wellbore, according to one or more embodiments described.

FIG. 2 depicts a cross sectional view of a service tool system for locating a completion in a wellbore and performing one or more hydrocarbon services, according to one or more embodiments. The service tool system 200 can include the service tool 100 secured within a completion or tubular member 210. The completion 210 can include a main body 220, a screen assembly 230, and a wash down shoe or mule shoe 240. An annulus 212 can be formed or located between the service tool 100 and the tubular member 210.

The main body 220 can be configured to connect to the body 115 of the service tool 100. The main body 220 can be connected to the screen assembly 230, and the screen assembly 230 can be connected to the wash down shoe 240. The wash down shoe 240 can include one or more flow control devices 245 disposed in an aperture or inner bore thereof. The flow control device 245 can selectively allow and/or prevent fluid flow from the wash pipe 150 through the aperture of the wash down shoe 240. The flow control device 245 can be a valve, such as a poppet valve.

When the screen assembly 230 is connected or engaged with the wash down shoe 240, the inner diameter of the screen assembly 230 and the wash down shoe 240 can form a seal. In one or more embodiments, one or more extensions can be disposed between the screen assembly 230 and the main body 220 and/or between the screen assembly 230 and the wash down shoe 240. The extensions can connect the screen assembly 230 with the main body 220 and the wash down shoe 240. As such, the extensions can be used to adjust the distance between the main body 220, the screen assembly 230, and the wash down shoe 240 to ensure that the service tool system 200 is configured to reach an entire target subterranean formation 208. The service tool system 200 can isolate, produce, and/or treat the subterranean formation 208. The screen assembly 230 can be used to perform a gravel pack operation on the wellbore 205.

The screen assembly 230 can be or include one or more sand screens 234. The sand screen 234 can be any filter media. Illustrative sand screens 234 are described in more detail in U.S. Pat. No. 6,725,929. The sand screen 234 can connect with the main body 220 at one end and with the wash down shoe 240 at the other end. In one or more embodiments, the screen assembly 230 can connect with a packer (not shown), such as a sump-packer. For example, the packer can be connected to the end of the wash pipe 150 in lieu of the wash down shoe 240. In another embodiment, the wash down shoe 240 can be integrated with or adjacent the packer (not shown).

The screen assembly 230 can also include one or more inflow control devices 238 and/or one or more shunt tube assemblies (not shown). The shunt tube assemblies can be used to bypass one or more sand bridges or other obstacles within the wellbore 205. The inflow control devices 238 can be connected to or integrated into the sand screen assembly 230. For example, the inflow control device 238 can be connected or integrated with the sand screen 234. Any inflow control device 238 that provides pressure drop therethrough can be used. Illustrative inflow control devices 238 are described in more detail in U.S. Pat. No. 6,857,475. The inflow control device 238 can control the flow of fluids from the wellbore 205 into the inner diameter of the tubular member 210. For example, the inflow control device 238 can balance the flow of fluid from the wellbore 205 into the inner diameter of the tubular member 210 by providing pressure drop to the fluids flowing therethrough.

The main body 220 can have one or more flow ports 250 formed therethrough. The flow port 250 can be in fluid communication with a portion of the annulus 212 between the sealing components 160, 165. In at least one specific embodiment, such as the one depicted in FIG. 2, the sealing components 160, 165 can be arranged about the body 115 to isolate a portion of the annulus 112 adjacent the flow port 250 from other portions of the annulus 112. Accordingly, fluid flow through the flow port 250 can be prevented from migrating to other portions of the service tool system 200 by the sealing components 160, 165. The flow port 250 can be or include one or more holes or apertures formed radially through the main body 220. One or more flow control devices 255 can be disposed about or within the flow port 250. The flow control device 255 can be a sliding sleeve or a valve. The flow control device 255 can be selectively switched between an "opened" or first position and a "closed" or second position. When the flow control device 255 is in the first configuration, the flow control device 255 allows fluid flow through the flow port 250, and when the flow control device 255 is in the second configuration, the flow control device 255 prevents fluid flow through the flow port 250. Accordingly, when the flow control device 255 is in the first configuration, the flow port 250 can provide fluid communication between the inner diameter of the second tubular member 210 and the wellbore 205. The flow control device 255 can be actuated without imparting motion to the service tool 100 relative to the wellbore 205. For example, the flow control device 255 can be actuated hydraulically, electronically, or mechanically. In one or more embodiments, a stored potential energy source can be used to actuate the flow control device 255. The stored potential energy source can be or include a battery, a capacitor, a spring, a fluidic accumulator, and/or differential pressure between hydrostatic and atmospheric chambers. The flow control device 255 can be actuated by one or more signals sent from the surface to the service tool 100 and/or tubular member 210 using the telemetry equipment 180. For example, the telemetry equipment 180 can transmit an electrical signal from the surface to a solenoid configured to actuate the flow control device 255.

One or more packers 260 can be disposed about the tubular member 210. For example, the packer 260 can be disposed about the exterior of the main body 220 and another packer (not shown) can be disposed adjacent the wash down shoe 240. The packer 260 can be used to isolate an "upper" or first portion of a target subterranean formation and secure the second tubular member 210 within the wellbore 205. The packer 260 can be any downhole sealing device. Illustrative packers 260 include compression or cup packers, inflatable packers, "control line bypass" packers, polished bore retrievable packers, swellable packers, other downhole packers, or combinations thereof. The packer 260 can seal an annulus between the tubular member 210 and wellbore 205 adjacent the subterranean formation 208 and/or provide a sealed bore through which an upper completion conduit can convey production fluid or injection fluid from and/or into the wellbore 205 adjacent the subterranean formation 208.

In one specific embodiment, such as the one depicted in FIG. 2, the wash pipe 150 can be connected to the service tool 100, as described in FIG. 1, and can engage or connect to the inner diameter of the wash down shoe 240. In one or more embodiments, the wash down pipe 150 can be releasably engaged with the inner diameter of the wash down shoe 240. Accordingly, when the wash pipe 150 is movably connected to the body 115, the wash pipe 150 can be extended to prevent fluid communication between the inner diameter of the wash pipe 150 and the annulus 212. In one or more embodiments, the wash pipe 150 can include the flow ports 155. The flow ports 155 can be configured to selectively move from the first configuration to the second configuration, without imparting motion to the wash pipe 150 or service tool 100 relative to the wellbore 205, to provide fluid communication between the annulus 212 and the inner diameter of the wash pipe 150.

In operation, the service tool system 200 can be assembled at the surface, and a drill pipe 202 can be connected to the body 115. After the drill pipe 202 is connected to the body 115, the drill pipe 202 can be used to convey the service tool system 200 into the wellbore 205. As the service tool system 200 is conveyed into the wellbore 205, the service tool system 200 can be in the first configuration. When the service tool system 200 is in the first configuration, the valve system 132 can be configured to prevent fluid flow through the flow ports 130, 140 and to allow fluid communication between the first portion and second portion of the aperture 112. Accordingly, the service tool 100 can be used to perform a washdown operation and/or one or more hydrocarbon services as the service tool system 200 is conveyed into the wellbore 205 to a proper location within the wellbore 205. The proper location can be when the screen assembly 230 is adjacent the subterranean formation 208. After the service tool system 200 is conveyed into and located within the wellbore 205, the tubular member 210 can be secured within the wellbore 205 by the packer 260.

After the tubular member 210 is located and secured within the wellbore 205, the service tool system 200 can be switched to an additional configuration without imparting longitudinal movement to the service tool 100 relative to the wellbore 205. In one or more embodiments, the telemetry equipment 180 can communicate a signal from the surface to the service tool system 200 causing the valve system 132 and/or other valves in the service tool system 200 to actuate, switching the service tool system 200 to a different configuration. When the service tool system 200 is in the different configuration, the service tool 100 and/or service tool system 200 can be used to perform one or more additional hydrocarbon services within the wellbore 205. In one or more embodiments, the service tool 100 can be configured to perform a well test after the service tool system 200 is located and set in the wellbore 205, and after the test is performed, the service tool 100 can be placed in a second configuration to provide gravel slurry or proppant to the wellbore 205. For example, a portion of the wellbore 205 adjacent the subterranean formation 208 can be pressurized to ensure that the packer 260 is properly functioning. In another embodiment, after the service tool system 200 is located and secured within the wellbore 205, the service tool 100 can be placed in the second configuration and used to perform one or more hydrocarbon services.

Figure 3:
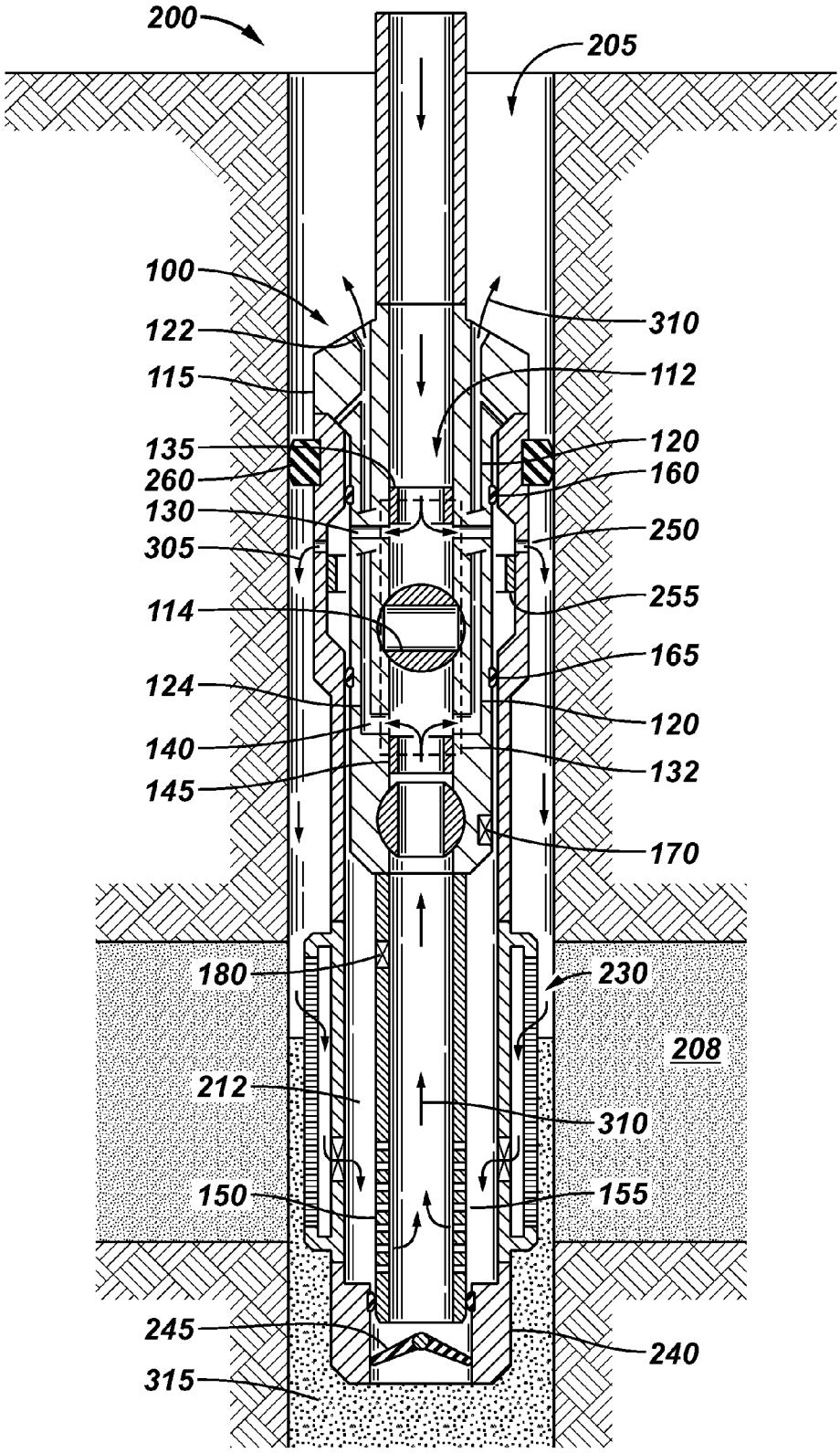
FIG. 3 depicts a cross sectional view of the service tool system of FIG. 2 performing a first hydrocarbon service within the wellbore, according to one or more embodiments described.

FIG. 3 depicts a cross sectional view of the service system of FIG. 2 performing a first hydrocarbon service within the wellbore, according to one or more embodiments. When the service tool system 200 is in the second configuration, the valve system 132 can be configured to provide a flow path through the flow port 130 between the first portion of the aperture 112 and the exterior of the body 115, and a flow path through the flow port 140 between the second portion of the aperture 112 and the channel 120. For example, the flow control devices 135, 145 can be placed in the first configuration. When the service tool system 200 is in the second configuration, the valve system 132 can also be configured to isolate the first portion of the aperture 112 from the second portion of the aperture 112. For example, the flow control device 114 can be in the second configuration. In addition, when the service tool system 200 is in the second configuration, the flow control device 255 can be in the first configuration. As such, the flow port 250 can provide a flow path between the annulus 212 and the wellbore 205. Accordingly, flow paths are formed between the aperture 112 and the wellbore 205 via flow ports 130, 250 and between the channel 120 and the second portion of the aperture 112 via flow port 140.

As such, the service tool system 200, in the second configuration, can be used to provide one or more fluids to and to circulate a portion of the fluids out of the wellbore 205. For example, the service tool system 200 can support gravel pack operations, well breaker treatment operations, well-bore clean up operations, fluid displacement operations, fluid replacement operations, wellbore testing operations, well control operations, well-kill operations, fluid injection operations, and production operations. In addition, the service tool 200 can perform injection tests on the wellbore 205 and/or a subterranean formation 208.

In at least one specific embodiment, the service tool 100 can be used to provide a gravel slurry 305 having a carrier fluid 310 and a proppant 315 and can circulate at least a portion of the carrier fluid to the surface. For example, as the gravel slurry 305 flows within the first portion of the aperture 112, at least a portion of the gravel slurry 305 can flow through the flow ports 130, 250 to the wellbore 205. As the gravel slurry 305 flows into the wellbore 205, at least a portion of the proppant 315 can pack about the screen assembly 230 adjacent the subterranean formation 208. As the proppant 315 packs about the screen assembly 230, the carrier fluid 310 can migrate through the screen assembly 230 to the aperture 212 via a flow path formed between the screen assembly 230 and the second portion of the aperture 112. The flow path formed between the screen assembly 230 and the second portion of the aperture 112 can be formed by one of dissolving the wash pipe 150, opening ports 155 integrated into the wash pipe 150, moving the wash pipe 150 to the second position or configuration, or providing fluid communication between the aperture of the wash pipe 150 and the inner diameter of the second tubular member 210 adjacent the wash down shoe 240. In one or more embodiments, the service tool system 200 can be deployed without attaching the wash pipe 150 to the body 115. As such, the aperture 112 can be in selective fluid communication with the aperture 212 by one or more flow control devices disposed proximate to the end of the body 115. After the carrier fluid 310 enters the second portion of the aperture 112, the carrier fluid 310 can flow through the flow port 140 to the second end 124 of the channel 120. The carrier fluid 310 can migrate within the channel 120 from the second end 124 to the first end 122, and exit the channel 120 at the first end 122 thereof. As the gravel pack operation is being conducted, the monitoring equipment 170 and/or the telemetry equipment 180 can provide the ability to monitor and convey gravel packing progress and efficiency information in real-time. For example, the pressure and temperature can be measured using the monitoring equipment 170 and the data related thereto can be transmitted to the surface using the telemetry equipment 180. The data can be measured and transmitted using any sensing and transmitting device and method. For example, one or more sensors or gauges can measure one or more wellbore properties, such as temperature within the wellbore, flow rate of the gravel slurry within the wellbore, and/or pressure within the wellbore, and the data related thereto can be transmitted to the surface using the telemetry equipment 180. For example, the data can be transmitted to the surface using acoustic methods or radioactive proppant. In one or more embodiments, a plurality of packers 260 can be disposed about the service tool system 200 (not shown) and can divide the wellbore 205 into multiple zones (not shown), and the monitoring equipment 170 and the telemetry equipment 180 can be selectively disposed about the service tool 100 to measure one or more wellbore properties in each zone.

The gravel pack operation can be terminated at any time. For example, the gravel pack operation can be terminated when the proppant screens-out about the screen assembly 230. When the proppant 315 screens-out transient pressure waves can be transmitted to downhole wellbore equipment (not shown). The service tool 100 can reduce transient pressure waves, which are transmitted to downhole well bore equipment during gravel packing or fracture packing, by providing communication between a higher and lower pressure areas of the wellbore during screen-out and reduces the magnitude of the pressure imparted on the downhole wellbore equipment. When the gravel pack operation is terminated, the service tool system 200 can be placed in one or more additional configurations to perform an additional hydrocarbon service. For example, the service tool 100 can be used to perform clean-up, flow-back, and well tests on the wellbore 205 adjacent the packed proppant 315. In one or more embodiments, such as depicted in FIG. 4, the service tool system 200 can be placed in a third configuration to perform one or more additional hydrocarbon services on the wellbore 205.

Figure 4:
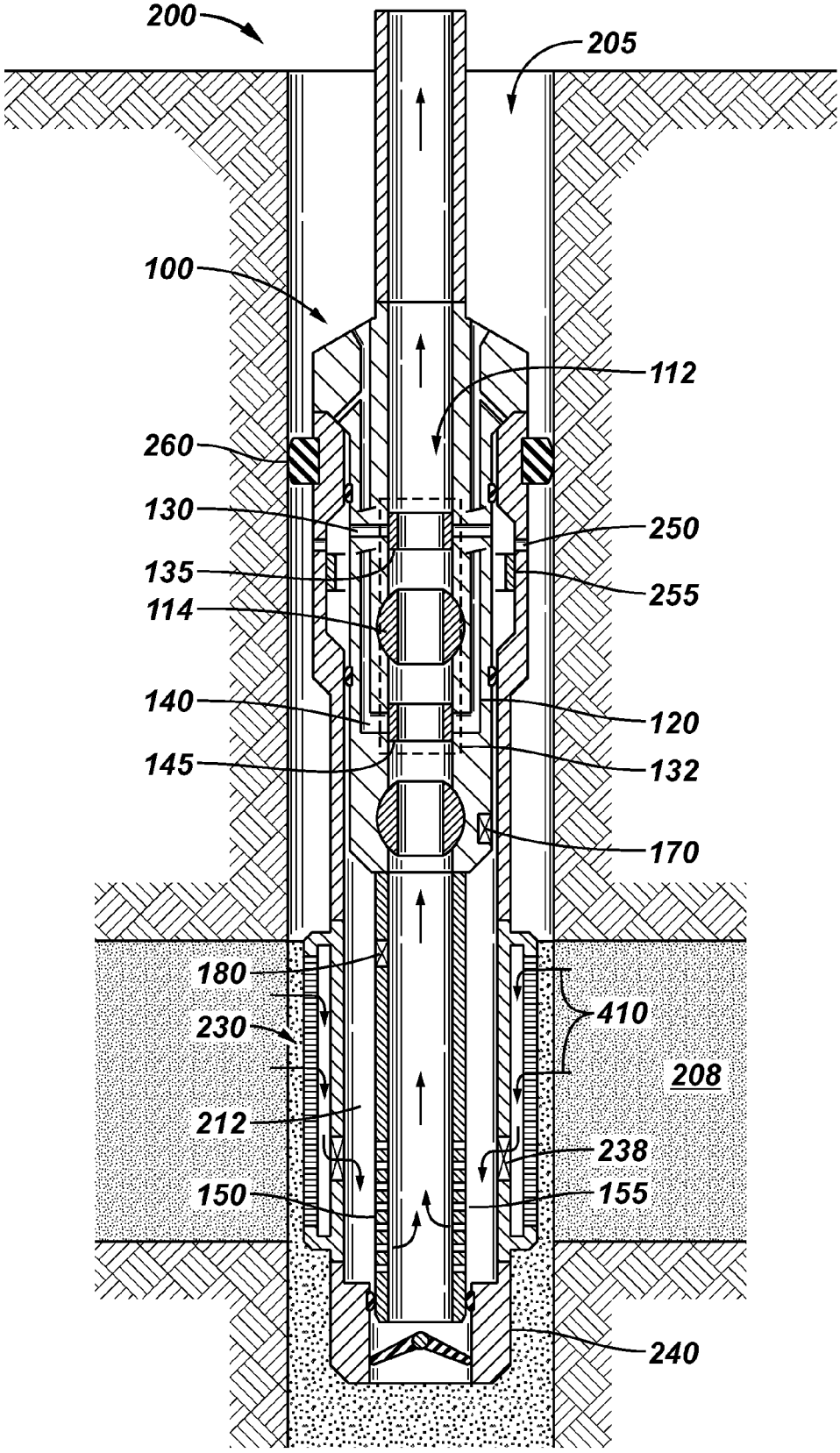
FIG. 4 depicts a cross sectional view of the service tool system of FIG. 2 performing a second hydrocarbon service within the wellbore, according to one or more embodiments described.

FIG. 4 depicts a cross sectional view of the service tool system of FIG. 2 performing a second hydrocarbon service within the wellbore, according to one or more embodiments. When the service tool system 200 is in the third configuration, the valve system 132 can be configured to provide a flow path between the first and second portion of the aperture 112 and prevent fluid flow through the flow ports 130, 140. Furthermore, the second portion of the aperture 112 can be in fluid communication with the annulus 212. For example, the flow control devices 135, 145 can be switched to the second configuration, and the flow control device 114 can be switched to the first configuration. Accordingly, the service tool 100 can be used to provide fluid communication between the surface and the wellbore 205. As such, the service tool 100 can be used to produce fluids or hydrocarbons 410 from the wellbore 205 and/or the subterranean formation 208 to the surface. The sand screen assembly 230, the inflow control devices 238, and/or the flow ports 155 can control the flow of fluid into and/or out of the wellbore 205. As such, the sand screen assembly 230, the inflow control devices 238, and/or the flow ports 155 can be configured to ensure efficient, optimized production of hydrocarbons from the subterranean formation 208 and/or wellbore 205. As the hydrocarbons 410 are produced from the wellbore 205 and/or subterranean formation 208, the monitoring equipment 170 can measure production logging information, and the telemetry equipment 180 can transmit the measured production logging information to the surface. The production logging information can include flow rate of hydrocarbons; identification of fluids, such as water, gas, and/or other fluids; pressure; temperature; and other wellbore data. The service tool system 200 and/or service tool 100 can provide on-off flow-control during the production of hydrocarbons 410.

Additionally, the service tool system 200, in the third configuration, can be used to test the wellbore 205 and/or service tool 100. For example, pressure can be applied to the wellbore 205 to ensure that the packer 260 and/or other packers (not shown) are properly isolating the subterranean formation 208 and/or a portion of the wellbore 205. The service tool system 200, in the third configuration, can also be used to perform clean up operations on the wellbore 205 and/or subterranean formation 208. For example, the service tool system 200 can be used to provide breaker fluid to the wellbore 205 to clean up mudcake adjacent the subterranean formation 208. The monitoring and telemetry equipment 170, 180 can be used to acquire test data, production data, and/or other wellbore data and transmit the data to the surface. As the service tool system 200 is used in the third configuration to provide one or more hydrocarbon services, the flow control device 255 can be either in a first or second configuration. After performing one or more hydrocarbon services within the wellbore 205 with the service tool system 200 in the third configuration, the service tool system 200 can be selectively switched to another configuration, such as the first configuration, the second configuration, or to any other configuration to perform one or more additional hydrocarbon services within the wellbore 205.

Figure 5:
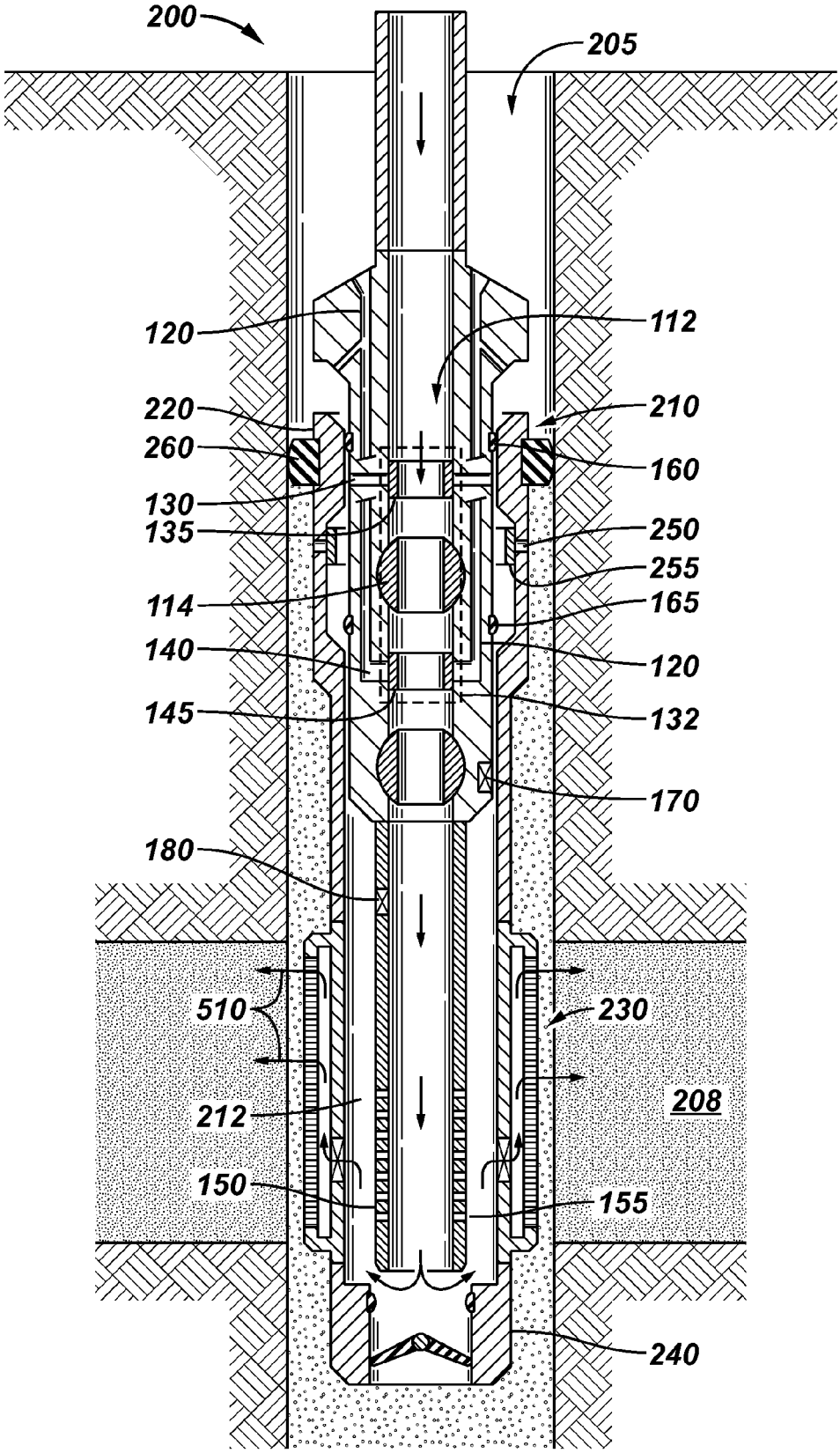
FIG. 5 depicts a cross sectional view of the service tool system of FIG. 2 performing a third hydrocarbon service within the wellbore, according to one or more embodiments described.

FIG. 5 depicts a cross sectional view of the service tool system of FIG. 2 performing a third hydrocarbon service within the wellbore, according to one or more embodiments. When the service tool system 200 is in the fourth configuration, the service tool 100 can be released from the tubular member 210, and the wash pipe 150 can be released from the wash down shoe 240. Furthermore, when the service tool system 200 is in the fourth configuration, the valve system 132 can be configured to provide fluid communication between the first and second portion of the aperture 112, and prevent fluid flow through the ports 130, 140. For example, the flow control devices 135, 145 can be in the second configuration, and the flow control device 114 can be in the first configuration. Furthermore, the flow control device 255 can be in the second configuration, and fluid flow through the flow port 250 can be prevented. Accordingly, when service tool system 200 is in the fourth configuration, service tool system 200 can treat, inject fluids into, stimulate, or otherwise work over the wellbore 205 and/or subterranean formation 208. For example, service tool system 200 can be used to provide acid or other treatment fluid 510 to the wellbore 205 to stimulate the production of hydrocarbons from the subterranean formation 208. The service tool 100 can preserve filter cake integrity within the wellbore 205, such as, at the wellbore interface, prior, during, and after the well treatment.

The monitoring and telemetry equipment 170, 180 can be used to measure wellbore data and transmit the data to the surface. The wellbore data acquired can be treatment data, stimulation data, or other wellbore data. After the service tool system 200 is used to perform one or more hydrocarbon services in the fourth configuration, the service tool system 200 can be switched back to the first, second, or third configuration and additional hydrocarbon services can be performed within the wellbore 205 and/or the service tool 100 can be removed and used to run an additional completion into the wellbore 205. In one or more embodiments, the service tool 100 can be removed from the wellbore 205 after performing any number of hydrocarbon services and used to run one or more additional completions into the wellbore 205.

Figure 6:
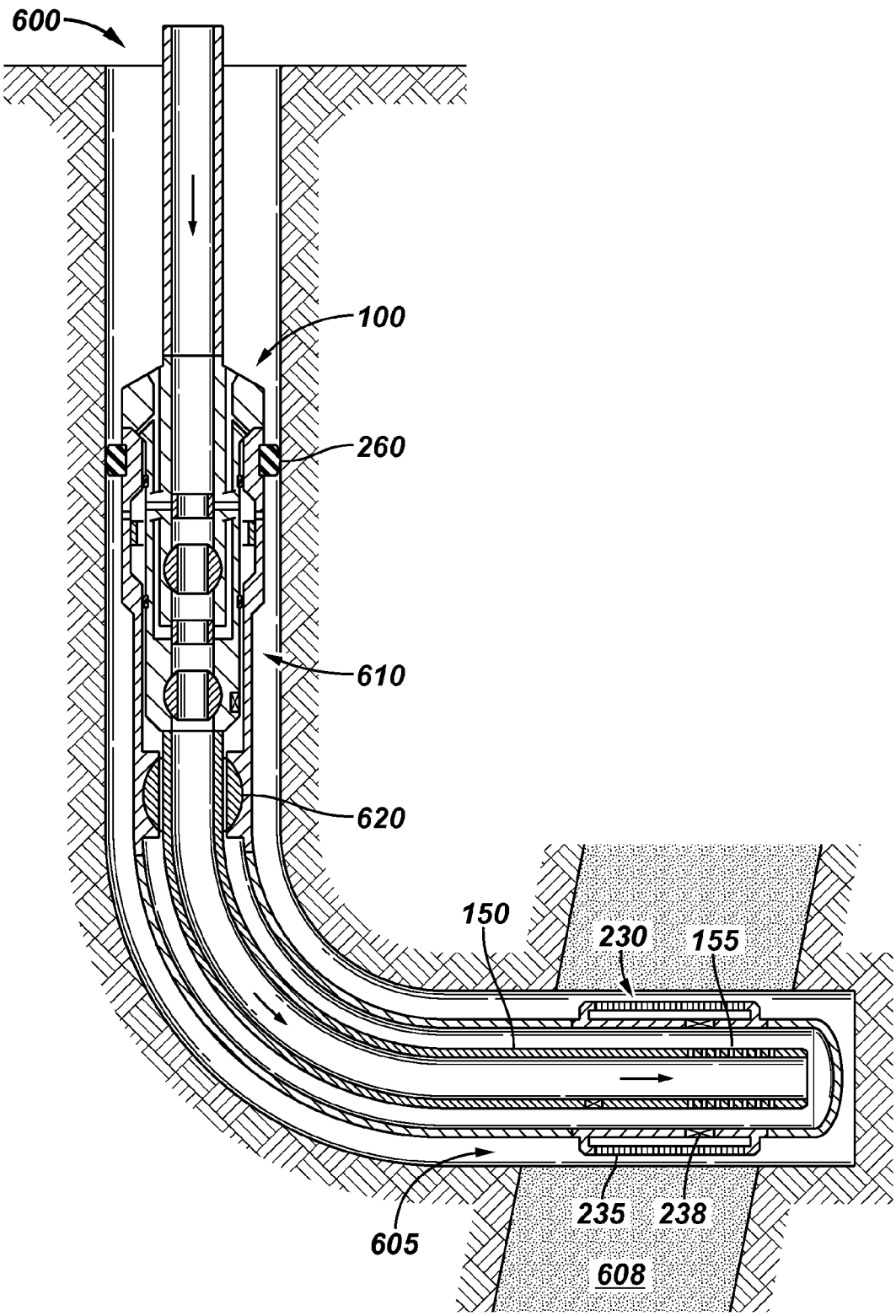
FIG. 6 depicts a cross sectional view of an illustrative service tool system disposed within a horizontal wellbore, according to one or more embodiments described.

FIG. 6 depicts a cross sectional view of an illustrative service tool system disposed within a horizontal wellbore, according to one or more embodiments. The service tool system 600 can be located within a wellbore 605. The wellbore 605 can be a horizontal or deviated wellbore. Accordingly, the wellbore 605 can have a heel and toe, and the wash pipe 150 can support wash-down through the service tool system 600 adjacent the toe of the wellbore 605, and the wash pipe 150 can open to provide a return flow path that enables gravel-pack operations, clean-up operations, flow-back operations, and production operations. The wash pipe 150 can provide the return flow path through the flow ports 155 formed therethrough. If the wash pipe 150 does not have ports 155, the wash pipe 150 can retract or dissolve to provide the return flow path. The return flow path can be formed without movement of the wash pipe 150 and/or the service tool 100 relative to the wellbore 605. The wellbore 605 can be a cased wellbore or an open wellbore as depicted. In one or more embodiments, the service tool system 600 can be deployed without the wash pipe 150, and the body 115 can provide wash down to the toe of the wellbore 605 and enable gravel-pack operations, clean-up operations, flow-back operations, and production operations. Further, the service tool 100 can enable preferential cleanup of filter cake, from the toe of the wellbore, the heel of the wellbore, or both. The clean up can be performed using a wash pipe 150 or without the wash pipe 150.

The service tool system 600 can include a service tool 100 connected to a completion or tubular member 610, at least one fluid loss control valve 620 can be connected to or disposed about the tubular member 610, the body 115, and/or the wash pipe 150. The tubular member 610 can include one or more screen assemblies 230. The screen assemblies 230 can include the sand screen 235 and the inflow control devices 238. One or more packers 260 can be disposed about the tubular member 610. The packers 260 can isolate one or more subterranean formations 608 and/or a portion of the wellbore 605.

The fluid loss control valve 620 can be connected to a portion of the service tool system 600. For example, at least a portion of the fluid loss control valve 620 can be connected to the service tool 100, the wash pipe 150, and/or the tubular member 610. The fluid loss control valve 620 can be integrated with the service tool 100 or connected to the service tool 100. The fluid loss control valve 620 can be used to selectively prevent fluid flow through a portion of the service tool system 600. The fluid loss control valve 620 can be or include a ball-valve at least partially integrated with or disposed on the service tool system 600, a flapper valve at least partially integrated with or disposed adjacent the service tool system 600, and/or a formation isolation valve at least partially integrated with or adjacent the service tool system 600. For example, the ball-valve can include a collet shifting tool attached to an end of the wash pipe 150 and a ball-valve disposed about the tubular member 610 adjacent or proximate to the packer 260. When the service tool 100 is removed from the tubular member 610, the collet can shift the ball-valve to a closed position, which can isolate the tubular member 610 from portions of the wellbore 605 to the "left" or "above" the packer 260. The ball-valve can be actuated after a "left" or second completion assembly (not shown) is installed in the wellbore 605. In addition, remote actuation such as hydraulic, electrical, or mechanical actuation can be used to selectively place the ball-valve in an "opened" or first configuration and/or a "closed" or second configuration allowing fluids to flow therethrough. In one or more embodiments, the telemetry equipment 180 can be used to send a signal from the surface instructing an actuator to open and/or close the ball-valve. For example, the telemetry equipment 180 can be connected to a portion of the tubular member 610 and can actuate or selectively place the ball-valve in the first configuration and/or a the second configuration. In another embodiment, a collet disposed on the service tool 100 can be used to actuate a formation isolation valve adjacent the packer 260 as the service tool 100 is removed or retrieved from the tubular member 610. After the service tool 610 is removed, remote actuation, such as using the telemetry equipment 180 to send a signal from the surface to an actuator, can be used to selectively place the formation isolation valve in an "opened" or first configuration and/or a "closed" or second configuration. In yet another embodiment, a flapper valve can be connected to the tubular member 610 adjacent the packer 260, and the flapper valve can move from an "opened" or first configuration to a "closed" or second configuration when the service tool 100 is removed from the tubular member 610. The flapper valve can be remotely actuated to move between the first and second configuration.

Figure 7:
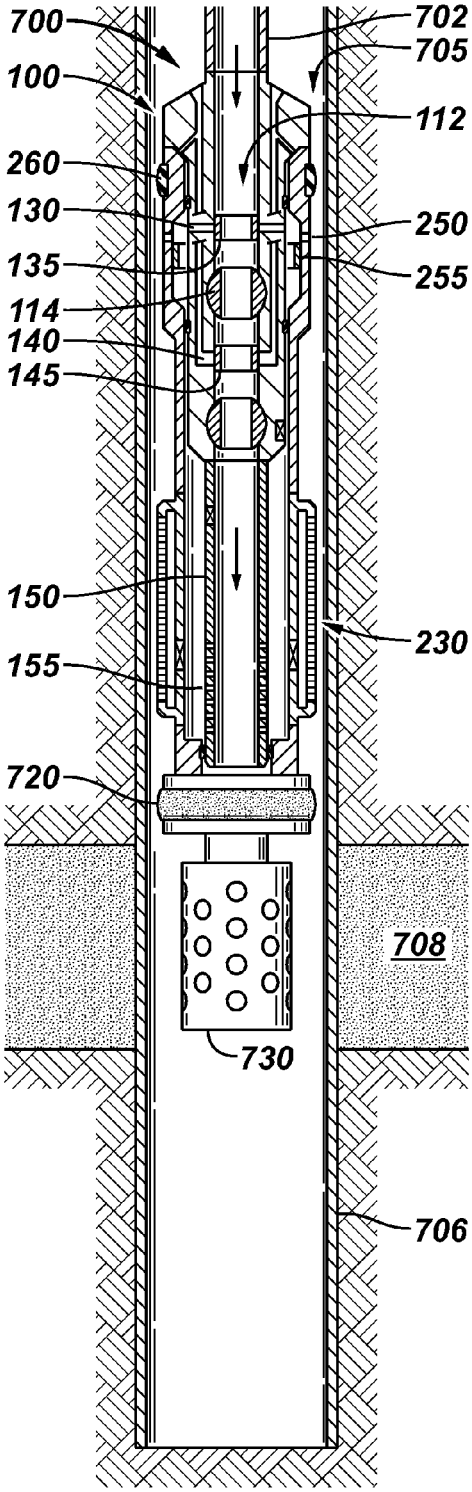
FIG. 7 depicts a cross sectional view of an illustrative service tool system disposed within a cased wellbore, according to one or more embodiments described.

FIG. 7 depicts a cross sectional view of an illustrative service tool system disposed within a cased wellbore, according to one or more embodiments. The service tool system 700 can include the service tool 100 having one or more perforating guns 730 connected thereto. The perforating gun 730 can be connected to the service tool 100 adjacent a packer 720, which can be a perforating packer, a sump packer, an isolation packer, a swellable packer, or any other packer. A tubular member 710 can be connected to the service tool 100 and to the packer 720. The tubular member 710 can include one or more packers 260 and one or more screen assemblies 230. In one or more embodiments, the screen assembly 230 can be connected to at least a portion of the packer 720.

The perforating gun 730 can be any device capable of perforating a casing 706 of a wellbore 705 adjacent one or more subterranean formations 708. For example, the perforating gun 710 can be a propellant perforating gun, a capsule perforating gun, a hollow carrier perforating gun, and/or a propellant pulse perforating gun. The perforating gun 730 can be connected to the packer 720 by a quick connect or other remotely releasable connector. The perforating gun 710 can be configured to perforate one or more subterranean formations 708. In one or more embodiments, the perforating gun 730 can be dissolvable.

In operation, the service tool system 700 can be assembled by connecting or integrating the telemetry equipment 180 and/or monitoring equipment 170 with one or more portions of the service tool 100 and/or the tubular member 710. The service tool 100 can be connected to the wash pipe 150, and the wash pipe 150 and service tool 100 can be disposed within the tubular member 710. A portion of the service tool 100 can be connected to the tubular member 710, and the tubular member 710 and wash pipe 150 can be connected with the packer 720, and the perforating gun 730 can be connected with the packer 720. After the service tool system 700 is assembled, a drill pipe 702 can be used to convey the service tool system 700 into the wellbore 705. As the service tool system 700 is disposed within the wellbore 705, the service tool system 700 is in the first configuration. When the service tool system 700 is in the first configuration, the valve system 132 can prevent flow through the flow ports 130, 140 and allow fluid communication between the first portion of the aperture and the second portion of the aperture. For example, the flow control device 114 can be placed in the first configuration, and the flow control devices 135, 145 can be placed in the second configuration. Furthermore, when the service tool 100 is in the first configuration, the flow control device 255 can be in the first configuration. As such, the flow port 250 provides fluid communication between the inner diameter of the tubular member 710 and the wellbore 705.

Figure 8:
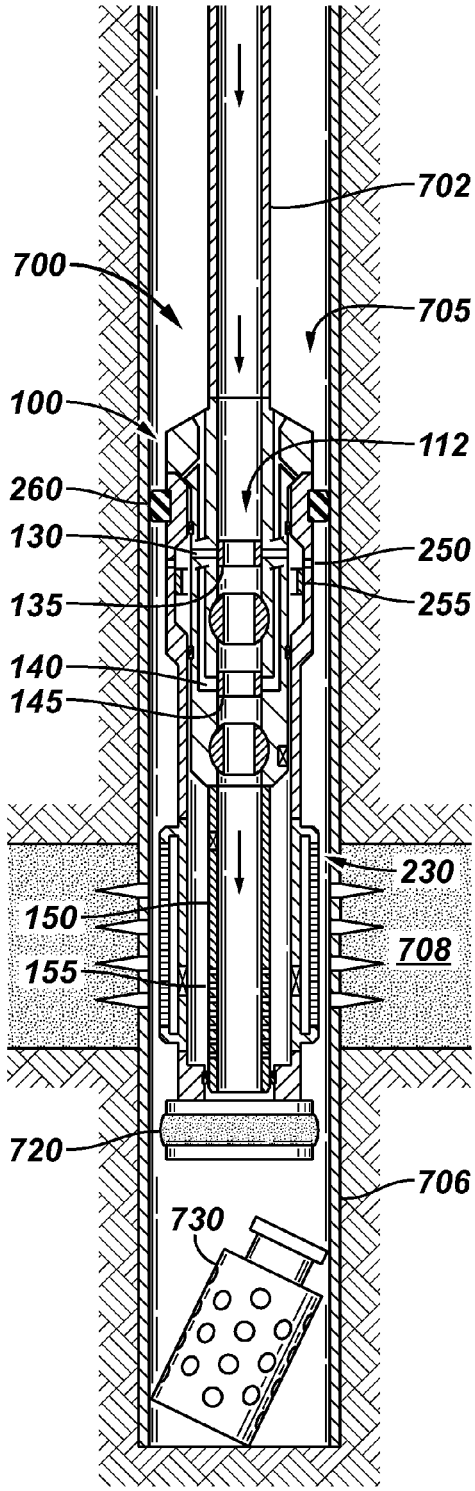
FIG. 8 depicts a cross sectional view of the service tool system of FIG. 7 set in the cased wellbore, according to one or more embodiments described.

When the perforating gun 730 is adjacent the subterranean formation 708, the perforating gun 730 can be used to perforate the casing 706 adjacent the subterranean formation 708. After the casing 706 is perforated, the perforating gun 730 can be released from the service tool system 700, as depicted in FIG. 8. FIG. 8 depicts a cross sectional view of the service tool system 700 set in the cased wellbore 705, according to one or more embodiments. Referring to FIGS. 7 and 8, after the perforating gun 730 is released from the service tool system 700, the screen assembly 230 can be aligned with the subterranean formation 708. When the screen assembly 230 is adjacent the subterranean formation 708, the sub-packer 720 and the packer 260 can be set in the wellbore 705. After the packers 720, 260 are set in the wellbore 205, the service tool system 700 can be placed in one or more configurations to perform one or more additional hydrocarbon services on the wellbore 705 and/or subterranean formation 708.

As discussed above, one or more hydrocarbon services can be performed with or without a wash pipe connected to the service tool. For example, a clean up operation, such as mud cake or filter cake clean up can be performed with or without the wash pipe attached to the service tool. The hydrocarbon service can be from the toe of a wellbore, the heel of the wellbore, or both. In one or more embodiments, a screen assembly and shunt tube assembly can be used to perform the services when the service tool is used without a wash pipe.

Figure 9:
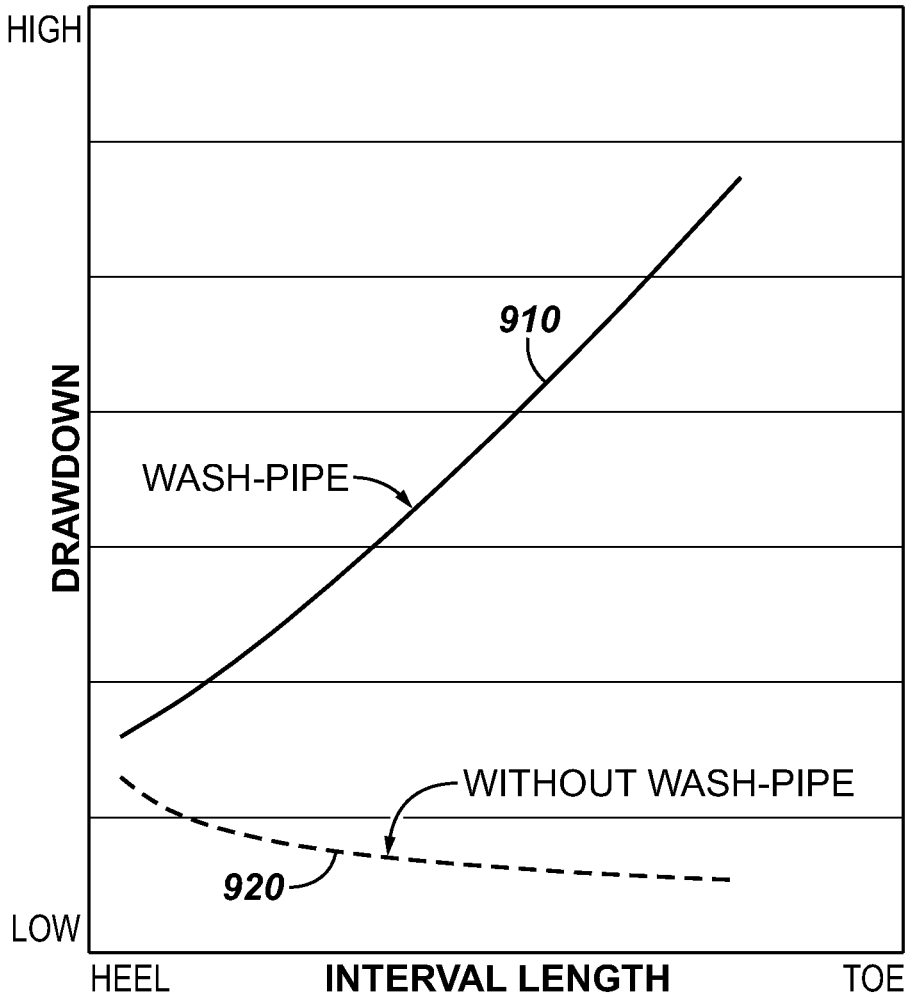
FIG. 9 depicts a graphical representation of the effect of a wash pipe on drawdown pressure in relation to interval length of a wellbore, according to one or more embodiments described.

FIG. 9 depicts a graphical representation of the effect of a wash pipe on drawdown pressure in relation to interval lengths of a wellbore. Line 910 represents the drawdown pressure behavior between a heel and toe of a wellbore when the service tool is connected to a wash pipe and used to perform a hydrocarbon service. As depicted, when the service tool and wash pipe are used to perform a hydrocarbon service, the drawdown pressure increases from the heel of the wellbore to the toe of the wellbore. Conversely, line 920 represents the drawdown pressure behavior between a heel and toe of a wellbore when the service tool without a wash pipe connected thereto is used to perform one or more hydrocarbon service. As depicted, when the service tool without a wash pipe connected thereto is used to perform one or more hydrocarbon service, the drawdown pressure decreases from the heel of the wellbore to the toe of the wellbore. It should be further noted that the drawdown pressure at the heel of the wellbore is substantially the same as the drawdown pressure at the toe of the wellbore.

Certain embodiments and features have been described using a set of numerical upper limits and a set of numerical lower limits. It should be appreciated that ranges from any lower limit to any upper limit are contemplated unless otherwise indicated. Certain lower limits, upper limits and ranges appear in one or more claims below. All numerical values are "about" or "approximately" the indicated value, and take into account experimental error and variations that would be expected by a person having ordinary skill in the art.

Various terms have been defined above. To the extent a term used in a claim is not defined above, it should be given the broadest definition persons in the pertinent art have given that term as reflected in at least one printed publication or issued patent. Furthermore, all patents, test procedures, and other documents cited in this application are fully incorporated by reference to the extent such disclosure is not inconsistent with this application and for all jurisdictions in which such incorporation is permitted.

While the foregoing is directed to embodiments of the present invention, other and further embodiments of the invention may be devised without departing from the basic scope thereof, and the scope thereof is determined by the claims that follow.

What is claimed is:

1. A system for performing at least two subterranean hydrocarbon services in a single trip downhole, comprising:

a service tool disposed within a tubular member forming an annulus therebetween, wherein the service tool comprises:

a body having an aperture formed therethrough;

a valve system connected to the body, the valve system comprising a first, second, and third flow control device, wherein a flow path between a first portion of the aperture and a second portion of the aperture is selectively formed by the first flow control device;

a first radial flow port formed through the body, wherein the second flow control device is positioned adjacent the first flow port for opening and closing the first flow port to selectively form a flow path between the first portion of the aperture, the first flow port, and an outer diameter of the body;

a first seal connected to the outer diameter of the body above the first flow port;

a second seal connected to the outer diameter of the body below the first flow port;

a channel formed in the body, wherein the channel is isolated from the first portion of the aperture;

a second radial flow port formed through the body, wherein the third flow control device is positioned adjacent the second flow port for opening and closing the second flow port to selectively form a flow path between the second portion of the aperture, the second flow port, and the channel, wherein the valve system forms at least one of the flow paths without longitudinal movement relative to a wellbore;

a wash pipe connected to the body, wherein a third radial flow port is formed through the wash pipe;

a wash down shoe, wherein the wash pipe is connected to the wash down shoe and forms a seal therewith;

a sensor disposed on the wash pipe and adapted to measure a flow rate of hydrocarbons being produced from the wellbore; and a transmitter disposed on the wash pipe and adapted to transmit data measured by the sensor to the surface;

wherein the tubular member comprises:

a main body;

a fourth flow port formed through the main body and axially between the first and second seals, wherein a flow path is selectively formed through the fourth flow port between the annulus and an exterior of the main body without longitudinal movement of the main body;

a packer connected to the main body and disposed above the fourth flow port;

a sand screen disposed adjacent the main body; and an inflow control device connected to the main body and disposed radially between the third flow port and the sand screen.

2. The system of claim 1, wherein the transmitter comprises telemetry equipment configured to provide two way telemetry between the wellbore and the exterior of the wellbore.

3. The system of claim 1, wherein the wash pipe is adapted to move with respect to the body.

4. The system of claim 1, wherein the wash pipe is dissolvable.

5. The system of claim 1, wherein the sand screen is connected to the wash down shoe.

6. The system of claim 1, wherein the wash down shoe comprises a fourth flow control device.

7. A method for performing at least two hydrocarbon services on a wellbore in a single trip downhole, comprising:

locating a service tool and a tubular member within a wellbore adjacent a subterranean formation, wherein the service tool is disposed at least partially within the tubular member, the service tool comprising:

a body having an aperture formed therethrough;

a valve system connected to the body, the valve system comprising a first, second, and third flow control device, wherein a flow path between a first portion of the aperture and a second portion of the aperture is selectively formed by the first flow control device;

a first radial flow port formed through the body, wherein the second flow control device is positioned adjacent the first flow port for opening and closing the first flow port to selectively form a flow path between the first portion of the aperture, the first flow port, and an outer diameter of the body;

a first seal connected to the outer diameter of the body above the first flow port;

a second seal connected to the outer diameter of the body below the first flow port;

a channel formed in the body, wherein the channel is isolated from the first portion of the aperture;

a second radial flow port formed through the body, wherein the third flow control device is positioned adjacent the second flow port for opening and closing the second flow port to selectively form a flow path between the second portion of the aperture, the second flow port, and the channel, wherein the valve system forms at least one of the flow paths without longitudinal movement relative to the wellbore;

a wash pipe connected to the body, wherein a third radial flow port is formed through the wash pipe;

a wash down shoe, wherein the wash pipe is connected to the wash down shoe and forms a seal therewith;

a sensor disposed on the wash pipe and adapted to measure a flow rate of hydrocarbons being produced from the wellbore; and a transmitter disposed on the wash pipe and adapted to transmit data measured by the sensor to the surface;

wherein during location of the service tool, the first and second flow ports are isolated from the aperture of the body by the valve system, and the flow path between the first portion of the aperture and the second portion of the aperture is unobstructed by the valve system;

wherein the tubular member comprises:

a main body;

a fourth flow port formed through the main body and axially between the first and second seals, wherein a flow path is selectively formed through the fourth flow port between the annulus and an exterior of the main body without longitudinal movement of the main body;

a packer connected to the main body and disposed above the fourth flow port;

a sand screen disposed adjacent the main body; and an inflow control device connected to the main body and disposed radially between the third flow port and the sand screen;

flowing a gravel slurry through the aperture of the body, the first flow port, and the fourth flow port, wherein the gravel slurry comprises a plurality of gravel particulates disposed within a carrier fluid;

flowing the carrier fluid through the sand screen, the inflow control device, the third flow port, and into the aperture of the body, such that the gravel particulates remain disposed radially outward from the sand screen; and flowing the hydrocarbons from the subterranean formation through the sand screen, the inflow control device, the third flow port, and into the aperture of the body without longitudinal movement of the body relative to the wellbore.

8. The method of claim 7, further comprising:

flowing at least a portion of the carrier fluid from the aperture of the body to the channel.

9. The method of claim 7, further comprising:

isolating the first flow port and the second flow port from the aperture of the body with the second and third flow control devices without moving the service tool relative to the wellbore; and providing fluid communication between the first portion and second portion of the aperture of the body with the valve system without moving the service tool relative to the wellbore.

10. The method of claim 9, further comprising real-time monitoring of the production rate of the hydrocarbons produced from the wellbore with the sensor.

11. The method of claim 7, further comprising:

perforating a casing disposed adjacent the subterranean formation with a perforating gun coupled to the body;

releasing the perforating gun from the body after the casing is perforated; and positioning the at least one sand screen adjacent the perforated casing.

12. The method of claim 7, further comprising introducing a fluid to the wellbore to stimulate production of the hydrocarbons from the subterranean formation.

13. A system for performing at least two subterranean hydrocarbon services in a single trip downhole, comprising:

a service tool disposed within a tubular member forming an annulus therebetween, wherein the service tool comprises:

a body having an aperture formed therethrough;

a valve system connected to the body, the valve system comprising a first, second, and third flow control device, wherein a flow path between a first portion of the aperture and a second portion of the aperture is selectively formed by the first flow control device;

a first radial flow port formed through the body, wherein the second flow control device is positioned adjacent the first flow port for opening and closing the first flow port to selectively form a flow path between the first portion of the aperture, the first flow port, and an outer diameter of the body;

a first seal connected to the outer diameter of the body above the first flow port;

a second seal connected to the outer diameter of the body below the first flow port;

a channel formed in the body, wherein the channel is isolated from the first portion of the aperture;

a second radial flow port formed through the body, wherein the third flow control device is positioned adjacent the second flow port for opening and closing the second flow port to selectively form a flow path between the second portion of the aperture, the second flow port, and the channel, wherein the valve system forms at least one of the flow paths without longitudinal movement relative to a wellbore;

a wash pipe connected to the body, wherein a third radial flow port is formed through the wash pipe;

a wash down shoe, wherein the wash pipe is connected to the wash down shoe and forms a seal therewith;

a sensor disposed on the wash pipe and adapted to measure a flow rate of hydrocarbons being produced from the wellbore; and a transmitter disposed on the wash pipe and adapted to transmit data measured by the sensor to the surface;

a perforating gun connected to the body, wherein the perforating gun is released from the body after the perforating gun perforates a casing adjacent a subterranean formation;

wherein the tubular member comprises:

a main body;

a fourth flow port formed through the main body and axially between the first and second seals, wherein a flow path is selectively formed through the fourth flow port between the annulus and an exterior of the main body without longitudinal movement of the main body;

a packer connected to the main body and disposed above the fourth flow port;

a sand screen disposed adjacent the main body; and an inflow control device connected to the main body and disposed radially between the third flow port and the sand screen.

14. The system of claim 13, wherein the third flow port is configured to be selectively opened and closed.

15. The system of claim 13, wherein the wash pipe is adapted to move with respect to the body.

16. The system of claim 13, wherein the wash pipe is dissolvable.

17. The system of claim 13, wherein the transmitter comprises telemetry equipment configured to provide two way telemetry between the wellbore and the exterior of the wellbore.

18. The system of claim 13, wherein the wash down shoe comprises a fourth flow control device.

* * * * *